US006739106B2

(12) United States Patent
Curatolo

(10) Patent No.: US 6,739,106 B2
(45) Date of Patent: May 25, 2004

(54) REVERSIBLE PLASTIC BUILDING BOARD WITH DIFFERENT COLORED SIDES

(75) Inventor: Tony Curatolo, Woodbridge (CA)

(73) Assignee: Royal Group Technologies Limited, Woodbridge (CA)

( * ) Notice: Subject to any disclaimer, the term of this patent is extended or adjusted under 35 U.S.C. 154(b) by 0 days.

(21) Appl. No.: 10/241,642

(22) Filed: Sep. 12, 2002

(65) Prior Publication Data

US 2004/0050007 A1 Mar. 18, 2004

(51) Int. Cl.[7] ..... E04C 3/00

(52) U.S. Cl. ..... 52/592.1; 52/650.3; 52/578; 52/731.3; 52/105

(58) Field of Search ..... 52/592.1, 589.1, 52/650.3, 177, 578, 309.1, 731.3, 731.2, 732.2, 732.1, 105

(56) References Cited

U.S. PATENT DOCUMENTS 3,984,961 A * 10/1976 Chieger et al. ..... 52/592.1
4,843,793 A * 7/1989 Ayers ..... 52/169.12
5,410,855 A * 5/1995 Clausen et al. ..... 52/747.1
5,411,782 A * 5/1995 Jarvis et al. ..... 428/57
5,758,467 A * 6/1998 Snear et al. ..... 52/592.1
5,836,128 A * 11/1998 Groh et al. ..... 52/580
6,044,598 A * 4/2000 Elsasser et al. ..... 52/181
6,199,340 B1 * 3/2001 Davis ..... 52/592.1
6,295,778 B1 * 10/2001 Burt ..... 52/592.6
6,314,701 B1 * 11/2001 Meyerson ..... 52/588.1
6,324,796 B1 * 12/2001 Heath ..... 52/177
6,591,567 B2 * 7/2003 Hota et al. ..... 52/578
2003/0019171 A1 * 1/2003 Thibault et al. ..... 52/177

* cited by examiner

*Primary Examiner*—Brian E. Glessner

(57) ABSTRACT

A plastic building board preferably used in the building of an outdoor deck has first and second opposite sides which are different in color from one another. The board also has a male connector at one of its side edges and a female connector at the other of its side edges. The male and female connectors are symmetrical to allow connection of the board with another corresponding board with either one of the colored sides in an upwardly facing direction.

4 Claims, 4 Drawing Sheets

REVERSIBLE PLASTIC BUILDING BOARD WITH DIFFERENT COLORED SIDES

FIELD OF THE INVENTION

The present invention relates to a plastic building board preferably for use in building an outdoor deck.

BACKGROUND OF THE INVENTION

As a result of its extremely durable nature, plastic material has taken on many different outdoor building uses in replacement of conventional wood building materials. For example, Royal Group Technologies Limited of Toronto, Ontario, Canada has developed a number of different plastic deck building materials. These deck building materials include materials for building both deck boards and deck railings.

To date even the most modern plastic deck boards are limited to a single color. Typically, that color is white which represents the color of most extruded plastic material. It is known to add pigmentation to change the basic white plastic to other colors such as brown or the like which is typical of the color used to paint a conventional wooden deck.

SUMMARY OF THE PRESENT INVENTION

The present invention relates to a plastic building board which is reversible in position within a building construction to vary the color of that construction.

More particularly, the present invention relates to a plastic building board having applications in different outdoor building uses such as an outdoor deck or the like. The plastic building board of the present invention has first and second opposite sides and first and second opposite side edges. The first side of the board is of a first color and the second side of the board is of a second color different from the color on the first side.

The first and second side edges of the board are connecting edges for connecting with other corresponding building boards. The first side edge of the board is a male connector which is symmetrical to opposite sides thereof and the second side edge is a female connector which is symmetrical to opposite sides thereof.

As a result of the symmetry of the male and female connectors the board can be reversed to place either the first or the second side of the board in an upwardly facing position. This allows the board to present one of the two colors to the opposite sides of the board.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Figure 1:
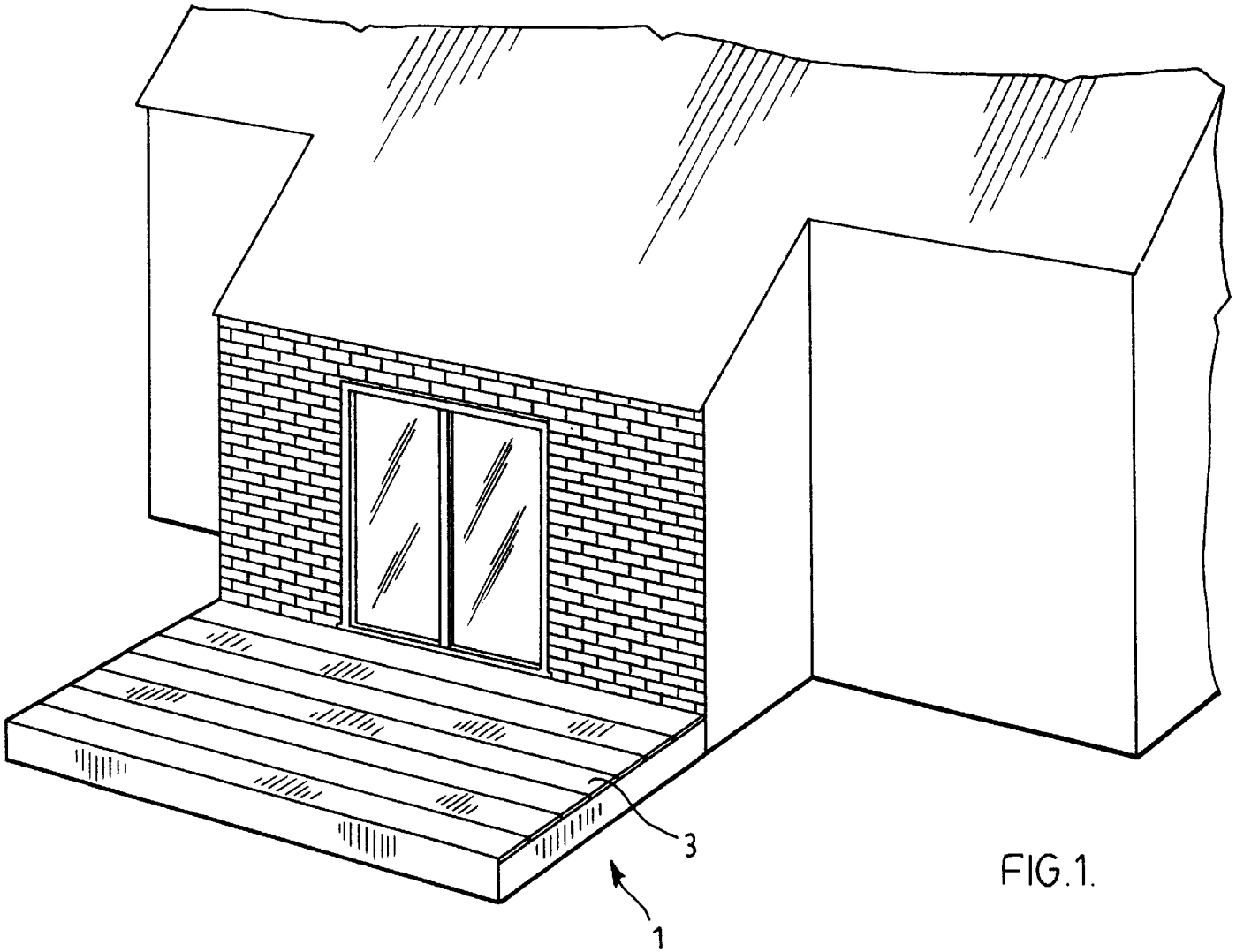
FIG. 1 is perspective view of an outdoor deck made from plastic building boards according to a preferred embodiment of the present invention.

FIG. 1 shows an outdoor deck generally indicated at 1 which is attached to a building construction. This deck includes an upper surface 3 which is made from a plurality of plastic building boards according to the present invention.

Figure 2:
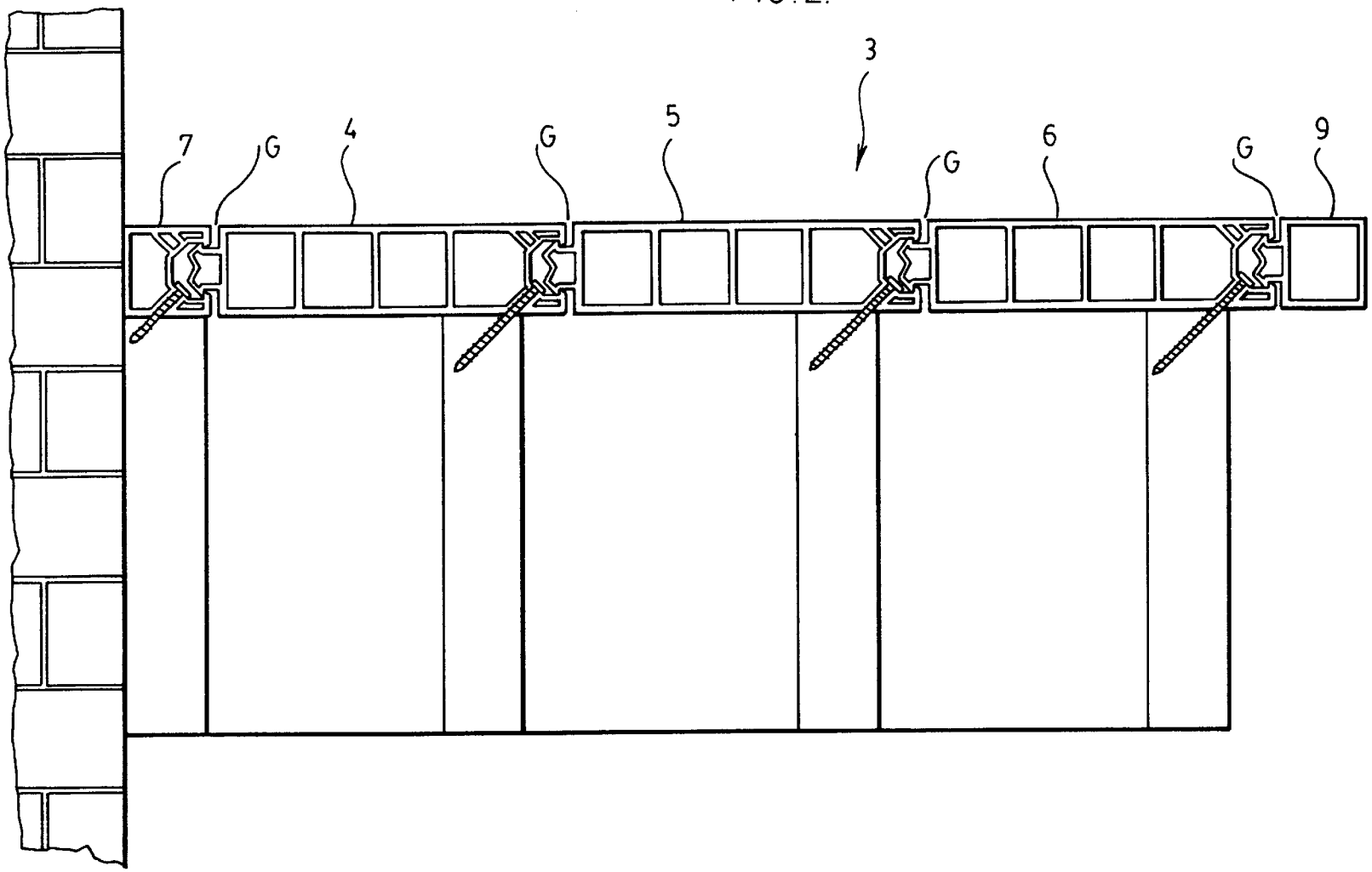
FIG. 2 is a sectional view through the deck of FIG. 1.

FIG. 2 shows deck surface 3 and more specifically the deck boards 4, 5 and 6 which are used to form the deck surface. Also included in the deck surface is a first deck board end cap 7 which structurally secures the deck boards to the building. In the particular example shown deck cap 7 secures into a stringer mounted to the building surface. It could equally as well secure directly into the brick of the building.

Provided to the other side of the deck is a second deck board cap 9. This particular cap is a finishing cap and is strictly decorative in purpose.

Figure 3:
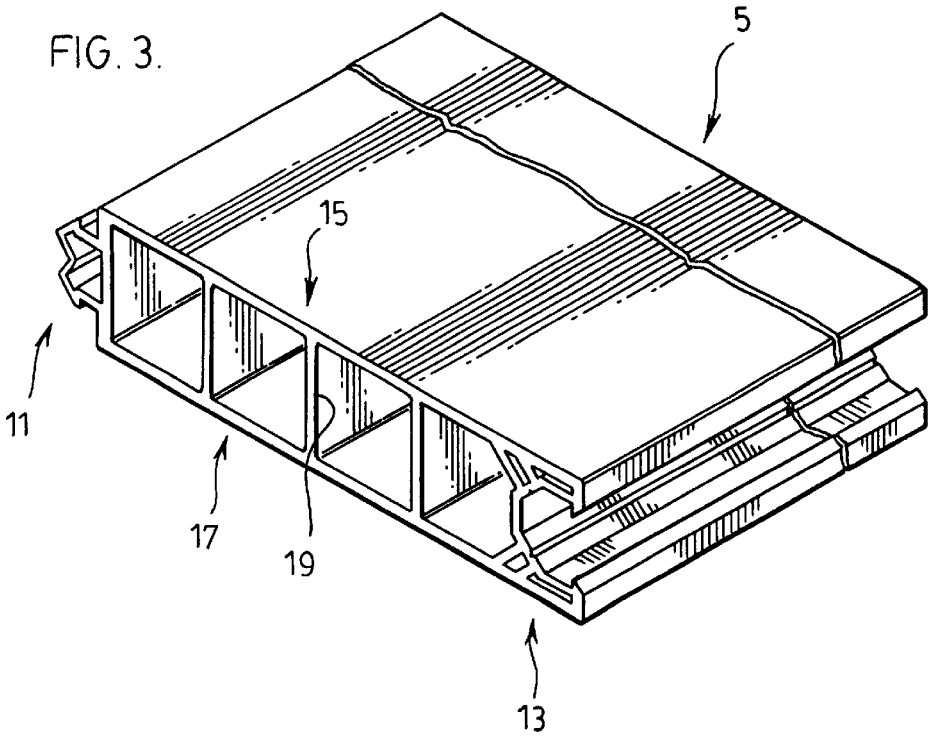
FIG. 3 is a perspective view of a section of one of the boards from the deck of FIGS. 1 and 2.
Figure 4:
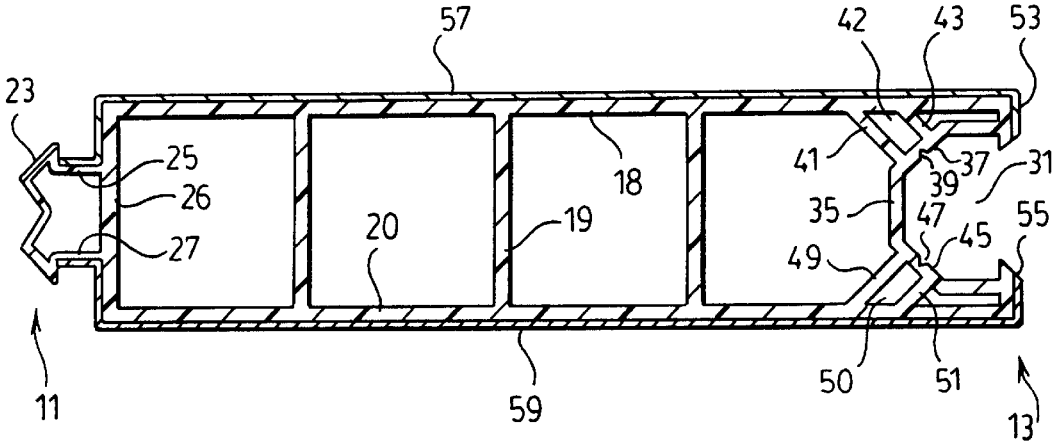
FIG. 4 is an enlarged sectional view of one of the building boards from the deck of FIGS. 1 and 2.

Referring in more detail to FIGS. 3 and 4 of the drawings it will seen that deck board 5 which is identical to deck boards 4 and 6 has a male connector 11 to one side edge of the board and a female connector 13 to the other side edge of the board. The board itself which preferably has a hollow extruded construction has a first sidewall 18 and a second sidewall 20. These sidewalls are spanned by interior vertical walls 19.

Male connector 11 comprises a cam shaped head 23 which projects from arms 25 and 27 outwardly from the side edge 26 of the deck board.

The female connector 23 comprises a mouth 31 which opens to an internal end stop wall 35. A pair of angled wall surfaces 37 and 45 are located to opposite sides of the mouth 31 connected to end stop wall 35. These angled wall surfaces are inclined relative to the axis of the board.

Wall surface 37 is provided with a small screw guide recess 39. A corresponding screw guide recess 47 is provided in wall surface 45.

Located behind wall surface 37 are a pair of angled walls 41 and 43. These walls define a screw port 42. Recess 39 in wall surface 37 is located centrally over screw port 42.

Located rearwardly of angled wall surface 45 are a pair of angled walls 49 and 51. These walls define a screw port 50. The recess 47 in angled wall surface 45 is located centrally over screw port 50.

The mouth 31 of the female receptacle is completed with a pair of arms 53 and 55 which extend in a direction radially of the deck board.

For reasons to be described later in detail the center axis of screw port 50 extending through recess 47 in angled wall surface 45 is slightly below the lower edge of arm 53. The center axis of screw port 42 extending through recess 39 in angled wall surface 37 lies slightly above the upper edge of arm 55.

All of the components of the deck board described thus far form the basic structure of the board. They are extruded in a single extrusion process from a common plastic material preferably polyvinyl chloride. The base polyvinyl chloride material may include a small amount of additional strengthening and weathering material such as glass material adapting the deck board for its outdoor use.

Referring once again to FIG. 3 deck board 5 as described to this point, comprises a board having a first side generally indicated at 15 and a second side generally indicated at 17. A male connector generally indicated at 11 is provided to one side edge of the board and a female connector generally indicated at 13 is provided to the other side of the board. The male connector 11 is symmetrical to its opposite sides as is the female connector 13.

In accordance with the present invention a layer of colored plastic material 57 is provided at the first side 15 of the deck board over the wall surface 18 of the basic structure of the board. A second layer 59 of colored plastic material is provided over the wall surface 20 of the base structure to the second side 17 of the deck board. Layers 57 and 59 are different in color from one another.

In accordance with a preferred embodiment of the present invention the layers 57 and 59 are co-extruded with the base structure of the deck board. This makes the colored layers extremely permanent.

It is to be noted from FIG. 4 that the layers 57 and 59 extend over the projecting arms 25 and 27 of the male connector and also along the radial arms 53 and 55 defining the mouth 31 of the female connector.

As is apparent from FIG. 4 and as shown in FIG. 2 of the drawings the head 23 of the male connector presents outwardly opening undercuts to opposite sides of the head. The female connector on the other hand presents inwardly directed undercuts to opposite sides of the mouth 31 of the female connector. The male connector and the female connector are symmetrical from one side to the other. This allows deck board 5 to be interlocked in a slide action with corresponding deck boards 4 and 6 as seen in FIG. 2 of the drawings. Furthermore, deck board 5 can be connected with these corresponding deck boards with either one of its sides 15 or 17 in the upwardly facing position. Accordingly, deck board 5 can be positioned such that colored layer 57 faces upwardly or colored layer 59 faces upwardly. Furthermore, the corresponding deck boards 4 and 6 which also have different colors to their opposite sides can be positioned selectively to either match with or present a different color from deck board 5.

The use of the earlier described screw ports can easily be seen in FIG. 2 of the drawings. These screw ports receive a mechanical fastener i.e., a threaded screw or the like to secure the deck boards to supports beneath the deck.

As earlier described the axis of each of the screw ports penetrates through the mouth of the female connector away from the mouth arms 53 and 55. Therefore the head of the screw is readily accessible to insertion of a tool such as a screwdriver or a drill bit. In other words, the arms 53 and 55 do not interfere with the insertion of the threaded fastener because of the angled positioning of the screw ports.

The mounting cap 7 at the one end of the deck has a mouth and screw port identical to the female connection end of each of the deck boards 4, 5 and 6. This therefore allows the use of a mechanical fastener to secure cap 7 to the stringer or the brick of the building.

The finishing cap 9 at the other side of the deck has a male connector identical to the male connectors of any one of the boards 4, 5 and 6. Therefore the finishing cap slides into a locking position with the female connector 6 of the outer most deck board.

The caps 7 and 9 may also have the same multiple color co-extrusion construction of the deck boards and be reversible in their up and down positions the same as the deck boards.

FIG. 2 of the drawings shows that there is a slight gap G at the connection points between each of the deck boards and between the deck boards and the end caps. This gap which can be closed by virtue of the fact that the mouth of each female connector is deeper than the head of each male connector. This allows a minor amount of adjustment between each of the deck boards and between the deck boards and the caps. This facilitates the installation of the deck and allows for tolerances in mounting the boards to their various different under-supports.

As earlier described the co-extruded layers of colored material extend onto the arms 25 and 27 of the male connector and down the arms 53 and 55 of the mouth of the female connector. Therefore even when there is a gap at the connection between each of the boards the entire upper surface of the deck including the area in the gaps is covered by the colored plastic material.

Figure 5:
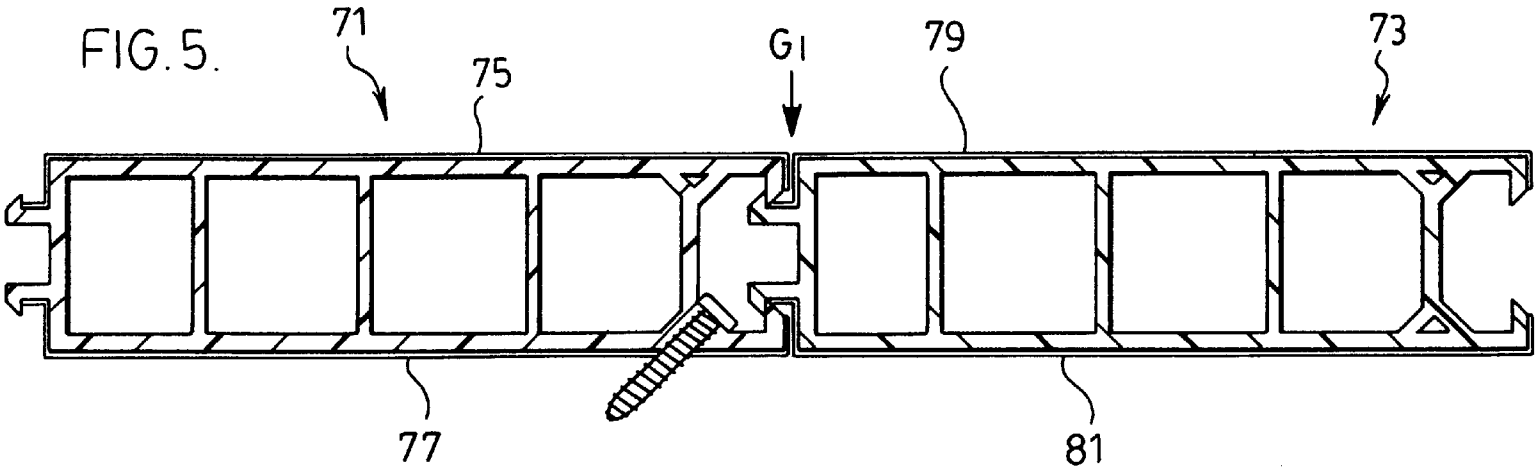
FIGS. 5 and 6 are sectional views of connected building boards according to a further preferred embodiment of the present invention.
Figure 6:
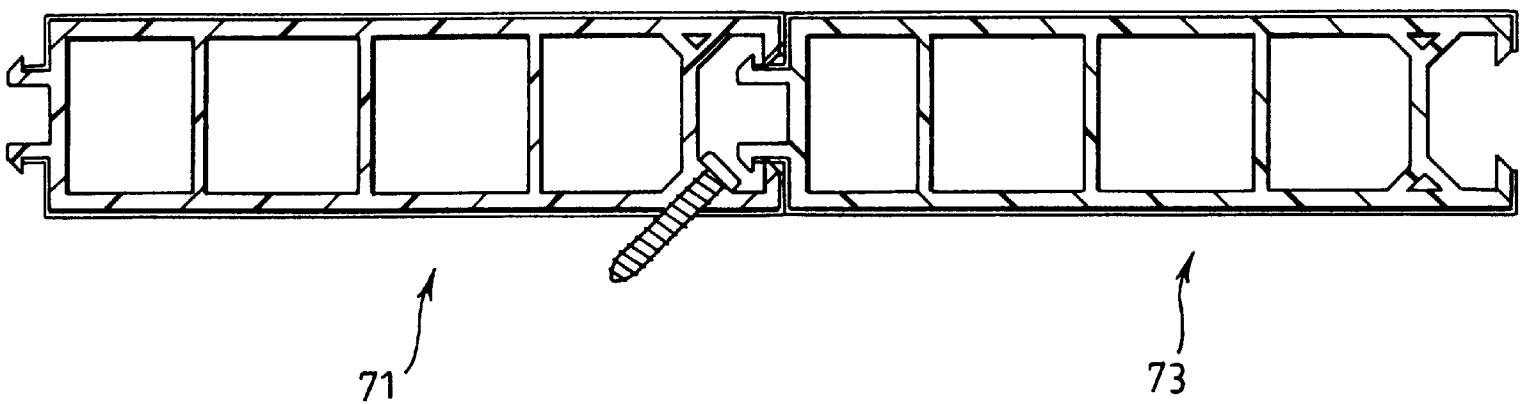

FIGS. 5 and 6 of the drawings show a pair plastic building boards 71 and 73 which again are preferably deck building boards. These boards are slightly modified from the deck boards thus far described.

More specifically boards 71 and 73 once again have a base structure formed by opposing sidewalls and male and female connectors to opposite side edges of each of the boards. Note that the male connector on each of the boards does not have a closed head construction as found in the earlier embodiments. It does however continue to have undercut barbs to interlock with the female mouth of the panel to which it is connected. There are also slight differences in the construction of the mouth with included screw ports. However the same basic design is consistent with the earlier embodiments.

What is clearly apparent from FIGS. 5 and 6 is the provision of the different colored co-extruded layers 75 and 77 to opposite sides of board 71 and similar layers 79 and 81 to opposite sides of board 73. Both boards are reversible to change the upwardly facing color on each of the boards.

What is also apparent in FIGS. 5 and 6 is that each of the co-extruded layers has a roughened or relief patterned surface. This makes each of the boards slip resistant adapting them to their preferred use in the building of an outdoor deck.

FIG. 5 shows boards 71 and 73 connected with a gap G1 between the facing side edges of the boards. Again this gap is completely spanned by the colored layers of the two boards. FIG. 6 shows how the two boards are connected with no gap between the side edges of the two boards. This is allowed because the male connecting arms of the board 73 are shorter than the depth of the female connector mouth of board 71. The ability to open and close the gap between the boards substantially eases installation of the deck in helping to line the deck boards up with the supports to which they are mounted.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A plastic building board having first and second opposite sides and first and second opposite side edges, the first side being a first color and the second side being a second color different from said first color, said first and second side edges being connecting edges for connecting with other corresponding building boards, said first side edge being provided with a male connector which is symmetrical to opposite sides thereof, said second side edge being provided with a female connector which is symmetrical to opposite sides thereof, said female connector comprising an open mouth with an interior mouth wall located over first and second screw ports, said first screw port being located between said mouth wall and said first side of said board and said second screw port being located between said mouth wall and said second side of said board.

2. A plastic building board as claimed in claim 1 wherein said mouth wall has inclined wall surfaces to opposite sides of said mouth wall, said first and second screw ports being covered by said inclined wall surfaces.

3. A plastic building board as claimed in claim 1 wherein said male connector comprises a connector head, said open mouth of said female connector having a front to back depth greater than that of said connector head.

4. A plastic building board as claimed in claim 3 wherein said connector head is secured to said first side edge by a first axially extending arm at said first side of said board and a second axially extending arm at said second side of said board, said open mouth at said second side edge of said board being bordered by a first radially extending arm at said first side of said board and a second radially extending arm at said second side of said board, said first radially extending arm and said first axially extending arm both having said first color and said second axially extending arm and said second radially extending arm both having said second color.

* * * * *